US009653238B2

(12) United States Patent
Gentsch

(10) Patent No.: US 9,653,238 B2
(45) Date of Patent: May 16, 2017

(54) EMBEDDED POLE PART WITH AN ISOLATING HOUSING

(71) Applicant: ABB TECHNOLOGY AG, Zurich (CH)

(72) Inventor: Dietmar Gentsch, Ratingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/688,217

(22) Filed: Apr. 16, 2015

(65) Prior Publication Data

US 2015/0221465 A1 Aug. 6, 2015

Related U.S. Application Data

(63) Continuation of application No. PCT/EP2013/003082, filed on Oct. 14, 2013.

(30) Foreign Application Priority Data

Oct. 16, 2012 (EP) ..... 12007163

(51) Int. Cl.
*H01H 33/662* (2006.01)
*H01H 33/666* (2006.01)

(52) U.S. Cl.
CPC .... *H01H 33/66207* (2013.01); *H01H 33/666* (2013.01); *H01H 2033/6623* (2013.01)

(58) Field of Classification Search
CPC .. H01H 33/66207; H01H 33/666; H01H 1/58; H01H 3/28; H01H 9/52; H01H 2033/6623; C08K 3/36; C08L 63/00
USPC ..... 218/139, 138, 155
See application file for complete search history.

(56) References Cited

U.S. PATENT DOCUMENTS 4,321,243 A * 3/1982 Cornwell ..... C01B 33/1417 423/268
5,698,831 A 12/1997 Abdelgawad et al.
5,718,759 A * 2/1998 Stav ..... A62D 1/0007 106/735
6,241,815 B1 * 6/2001 Bonen ..... C04B 28/145 106/735
2008/0142485 A1 * 6/2008 Gentsch ..... B29C 45/14639 218/118

(Continued)

FOREIGN PATENT DOCUMENTS

EP 1176171 A2 1/2002
EP 2058366 A1 5/2009

(Continued)

OTHER PUBLICATIONS

Machine translaton JP 2009-79650 (Original doc. published Apr. 2009).*

(Continued)

*Primary Examiner* — Renee Luebke
*Assistant Examiner* — William Bolton
(74) *Attorney, Agent, or Firm* — Taft Stettinius & Hollister LLP

(57) ABSTRACT

An exemplary embedded pole part with an isolating housing, which accommodates a vacuum interrupter as well as electric terminals by an injected embedding material, wherein the injected embedding material is filled with silica based on silicon dioxide as filler material, and the silica is silica fume, which includes amorphous, non-porous spheres of silicon dioxide and agglomerates thereof.

19 Claims, 2 Drawing Sheets

(56) References Cited

U.S. PATENT DOCUMENTS

| | | | | |
|---|---|---|---|---|
| 2012/0088602 | A1* | 4/2012 | Morken | A43B 5/001 473/371 |
| 2012/0175346 | A1 | 7/2012 | Shang | |
| 2013/0126479 | A1 | 5/2013 | Shang | |

FOREIGN PATENT DOCUMENTS

| | | | | |
|---|---|---|---|---|
| EP | 2278601 | A1 | 1/2011 | |
| EP | 2407989 | A1 | 1/2012 | |
| FR | WO2011028125 | A1 * | 3/2011 | C09D 7/12 |
| JP | 200979650 | * | 4/2009 | F16L 59/06 |

OTHER PUBLICATIONS

Silica fume—http:en.wikipedia.org/wiki/Siliac_fume (doc. modified Oct. 26, 2015).*

International Search Report (PCT/ISA/210) mailed on Jan. 24, 2014, by the European Patent Office as the International Searching Authority for International Application No. PCT/EP2013/003082.

Written Opinion (PCT/ISA/237) mailed on Jan. 24, 2014, by the European Patent Office as the International Searching Authority for International Application No. PCT/EP2013/003082.

* cited by examiner

EMBEDDED POLE PART WITH AN ISOLATING HOUSING

RELATED APPLICATION(S)

This application is a continuation of International Application No. PCT/EP2013/003082 filed on Oct. 14, 2013, designates the U.S., and claims priority to Japanese Application No. 12007163.4 filed on Oct. 16 2012. The content of each prior application is hereby incorporated by reference in its entirety.

FIELD

The present disclosure relates to an embedded pole part with an isolating housing, and particularly to an isolating housing that accommodates a vacuum interrupter as well as electric terminals by an injected embedding material.

Furthermore, the present disclosure relates to a vacuum circuit breaker for low-, medium- or high voltage applications comprising at least one of such embedded pole parts.

BACKGROUND INFORMATION

Known embedded pole parts are usually integrated in a medium voltage to high voltage circuit breaker. Medium voltage circuit breakers are rated between 1 kV and 72 kV of a high current level. These specific circuit breakers interrupt the current by creating and extinguishing the arc in a vacuum container. A pair of corresponding electrical switching contacts is accommodated inside the vacuum container. Modern vacuum circuit breakers attend to have a longer life expectancy than former air circuit breakers. Although, vacuum circuit breakers replace air circuit breakers, the present disclosure is not only applicable to vacuum circuit breakers but also for air circuit breakers or modern SF6 circuit breakers having a chamber filled with sulfur hexafluoride gas instead of vacuum.

The document EP 2 278 601 A1 discloses an embedded pole part with an isolating housing made of thermoplastic material, which accommodates a vacuum interrupter as well as electric terminals wherein at the outer surface of the housing horizontal and/or vertical aligned 3-dimensional structures joined by material engagement are implemented into the thermoplastic material, in order to achieve a higher mechanical stiffness as well as higher creepage length of the embedded pole part.

The embedding of vacuum interrupters in epoxy material is a well-tested technology and in this technique the filling pressure is low and it will not cause damage of the vacuum interrupter. Furthermore, the force on the electric terminal is also not critical and no special fixation is needed, but the filling time and curing time are relatively long. Injection moulding of thermoplastic material is also used in this field of technology. During the injection moulding process, the pressure in the cavity of the mould is very high during the filling and packing period. By using injective moulding method with thermoplastic material instead of epoxy material to embed the vacuum interrupter inside the insulation material, the difference is the pressure value applied to the insert. At reactive epoxy moulding situation the pressure can be from several bars to maximum 20-30 bars.

In injection moulding for vacuum interrupters, the maximum pressure could reach several hundred bars. When considering the long-term stability of thermoplastic material, the water affinity (the water up-take) of the thermoplastic material should be taken into account.

Known embedded pole parts which are made by epoxy material are filled with aluminum oxide or silica based on silica dioxide as filler material with a percentage of 50 wt.-%. to 70 wt.-%. The rest of the injected embedding material is the epoxy material to wet the filler material. The quantity of the filler material cannot be increased because the viscosity of the injected embedding material increases too, so that the injected embedding material could not flow through the pumping and the pipe system. Therefore, the molding to produce the epoxy part such as for the embedded pole part that cannot be sufficiently filled. Another aspect is the mechanical property of the produced part. The standard powder like silica particles as well as the fused silica particles have sharp edges so that under mechanical or dielectric load the embedded pole part is limited in these both properties.

It is a key-condition, for embedded pole parts to strengthen the pole part mechanically in such a way, that it is strong enough to withstand the short circuit current. Furthermore, it should have enough mechanical withstand, to fix the vacuum interrupter in the circuit breaker during mechanical stress if it is switched. Under these conditions, it is also important to care for dielectric stability.

SUMMARY

An exemplary embedded pole part is disclosed, comprising: an isolating housing, which includes a vacuum interrupter and electric terminals by an injected embedding material, wherein the injected embedding material is filled with silica based on silicon dioxide as filler material, wherein the silica is silica fume microsilica, which includes amorphous, non-porous spheres of silicon dioxide and agglomerates thereof.

BRIEF DESCRIPTION OF THE DRAWINGS

The foregoing and other aspects of the disclosure will become apparent following the detailed description of the disclosure, when considered in conjunction with the enclosed drawings, in which.

Figure 1:
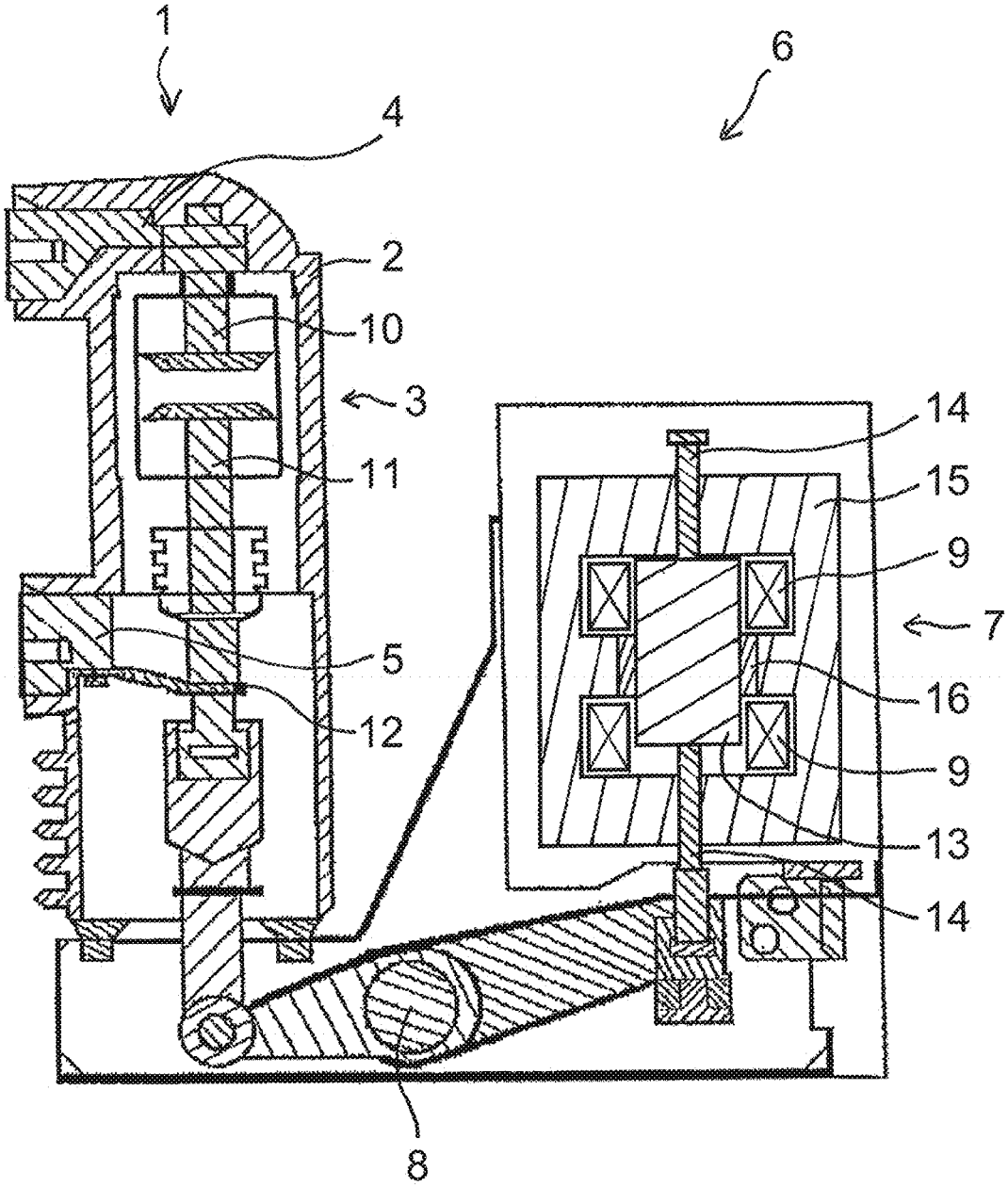
FIG. 1 shows a schematic longitudinal cut through a medium voltage vacuum circuit breaker operated by a single electromagnetic actuator via a jackshaft arrangement in accordance with an exemplary embodiment of the disclosure.

The reference symbols used in the drawings, and their meanings, are listed in summary form in the list of reference symbols.

DETAILED DESCRIPTION

Exemplary embodiments of the present disclosure provide an embedded pole part with improved material properties, wherein injected embedding material is filled with aluminum oxide or silica based on silicon dioxide as filler material According to an exemplary embodiment of the present disclosure the alumina or silica which is used as filler material for filling the embedding material is silica fume, which includes amorphous, non-porous spheres of silicon dioxide and agglomerates thereof. The use of silica fume, also known as microsilica, improves the mechanical properties of the embedded pole part, because of the small silica spheres, which have no sharp edges and are close together. Embedded particles with sharp edges act like notches inside the material. A further advantage is that the flow in the mould and the filling of the mould will be easier. Furthermore, the dielectric properties are improved because the number of sharp edged inside the material is greatly reduced. A further effect is that the shrinkage of the compound material is decreased resulting in lower mechanical stress inside the material after curing of the part in case the filler quantity can be increased at least up to 5% or more.

According to another exemplary embodiment of the present disclosure, the injected embedding material is duroplastic material, such as an epoxy material. An important advantage of epoxy material is that low pressure injection can be used. Therefore, the viscosity of the compound material has to be low. The mechanical behavior is improved by the implementation of the amorphous, non-porous spheres of silicon dioxide and the good behavior of the wetting of the epoxy material to the amorphous, non-porous spheres of silicon dioxide.

According to an exemplary embodiment described herein, average particle size of the amorphous, non-porous spheres of silicon dioxide is smaller than 0.3 micron, more preferably smaller than 0.2 micron, most preferably smaller than 0.15 micron. Furthermore, an average particles size of the agglomerates of the amorphous, non-porous spheres of the silicon dioxide can be smaller than 2 micron, more preferably smaller than 1.5 micron, and most preferably smaller than 1 micron.

Therefore the material properties during the manufacturing are improved. The viscosity of the compound material will be decreased, wherein the percentage of the filling material can be increased. The viscosity of the compound material is decreased, because of the ultrafine powder comprising sub-micron spheres of silicon dioxide. As smaller the average particle size of the amorphous, non-porous spheres of the silicon dioxide is, as more the viscosity of the compound material can be decreased. Silica fume contains two types of agglomerates of amorphous, non-porous spheres of silicon dioxide. Primary agglomerates are above mentioned and should be most preferably smaller than 1 micron. Secondary agglomerates are larger, such as 5-50 micron. These secondary agglomerates are easily broken down to primary agglomerates when the silica fume is mixed with water.

Moreover, a bulk density of the silica fume can be between 100 kg/cbm and 1000 kg/cbm, more preferably between 200 kg/cbm and 800 kg/cbm, and most preferably between 250 kg/cbm and 700 kg/cbm. According to an exemplary embodiment, a bulk density of the silica fume is between 2.1 t/cbm and 2.4 t/cbm, and more preferably between 2.2 t/cbm and 2.3 t/cbm. The bulk density is connected to the average particle size of the amorphous, non-porous spheres of the silicon dioxide. Furthermore, the bulk density is depending on the grade. As smaller the average particle size of the amorphous, non-porous spheres of the silicon dioxide is, as closer the amorphous, non-porous spheres of the silicon dioxide can move together, so that the bulk density decreases.

According to another exemplary embodiment, the filler material can have a percentage of more than 60 wt.-%, more preferably more than 70 wt.-%, and most preferably more than 80 wt.-%. Through a higher filling material content the flame retardant class can be increased, wherein the epoxy material is reduced in a certain volume. Furthermore, an increasing density of the compound and later on at the cured part generated by small amorphous, non-porous spheres of silicon dioxide can be found inside the gaps between bigger agglomerates of amorphous, non-porous spheres of silicon dioxide. The quantity of epoxy material is reduced, the cycle time of the process is in addition reduced, due to the exothermic reaction of the epoxy is less. Furthermore, the warm capacity of the filling material is in parallel also increased, so that the total cycle time can be reduced. In addition to this, the viscosity of the compound is reduced and the quantity of the filling material can be increased, wherein at the same time the quantity of expensive epoxy material can be decreased. Moreover, manufacturing of the embedded pole parts are expected to be easier and with higher quality and with better reproducibility.

According to yet another exemplary embodiment of the embedded pole part, the injected embedding material is thermoplastic material. The use of thermoplastic material can reduce the weight of the pole part. Furthermore, thermoplastic material can have a reduced density. Using thermoplastic material calls for the use of high injection pressure.

According to yet another exemplary embodiment of the embedded pole part, the injected embedding material is silicone.

FIG. 1 shows a schematic longitudinal cut through a medium voltage vacuum circuit breaker operated by a single electromagnetic actuator via a jackshaft arrangement in accordance with an exemplary embodiment of the disclosure. The medium voltage vacuum circuit breaker 6 as shown in FIG. 1 includes an embedded pole part 1 with an isolating housing 2 with an embedded upper electrical terminal 4 and a lower electrical terminal 5 forming an electrical switch for a medium voltage circuit. Therefore, the upper electrical terminal 4 is connected to a corresponding fixed upper electrical contact 10 which is mounted in a vacuum interrupter 3. A corresponding movable lower electrical contact 11 is movably mounted in relation to the vacuum interrupter 3. The lower electrical terminal 5 is connected to the corresponding movable lower electrical contact 11. The movable lower electrical contact 11 is movable between a closed and opened switching position via a jackshaft arrangement 8.

A flexible conductor 12 of copper material is provided in order to electrically connect the lower electrical terminal 5 with the movable lower electrical contact 11. The jackshaft arrangement 8 internally couples the mechanical energy of an electromagnetic actuator 7 to the isolating housing 2 of the vacuum interrupter 3. The electromagnetic actuator 7 includes of a movable ferromagnetic plunger 13 which is guided by two axes 14 in a ferromagnetic frame 15. Permanent magnets 16 are arranged on an inner extent area of the ferromagnetic frame 15 to create a magnetic flux so that the movable ferromagnetic plunger 13 is tightly held in one of the two end positions. Two coils 9, one at the top and the other at the bottom of the ferromagnetic frame 15, are partially arranged inside the ferromagnetic frame 15 and can be used to modify the magnetic flux in a way that the movable ferromagnetic plunger 13 can move from a top position to a bottom position. The movable ferromagnetic plunger 13 at the top position represents an open position of the medium voltage vacuum circuit breaker 6.

Figure 2:
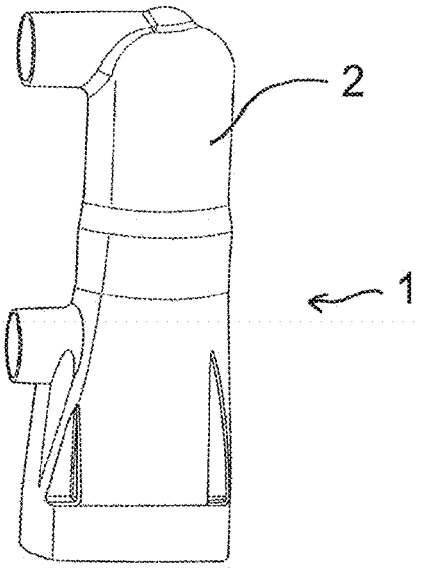
FIG. 2 is a perspective view of the embedded pole part in accordance with an exemplary embodiment of the disclosure.

FIG. 2 is a perspective view of the embedded pole part in accordance with an exemplary embodiment of the disclosure. Namely, FIG. 2 shows an exemplary embodiment with a flat shape of the isolating housing 2 of an embedded pole part 1. The exemplary embodiment of FIG. 2 illustrates the isolating housing 2 which is made of the proposed silica fume having amorphous, non-porous spheres of silicon dioxide and agglomerates of these according to the present disclosure.

Figure 3:
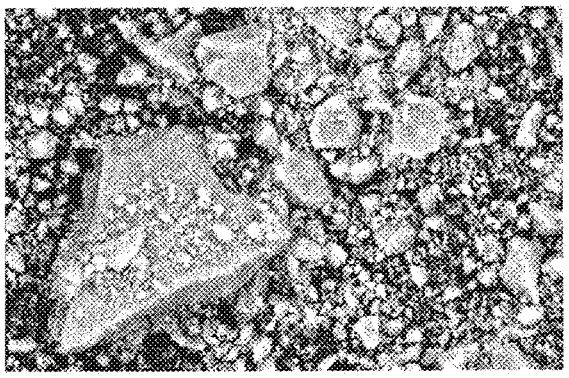
FIG. 3 shows the morphology of fused silica in accordance with an exemplary embodiment of the disclosure.

FIG. 3 shows the morphology of fused silica in accordance with an exemplary embodiment of the disclosure. For example, FIG. 3 is an electron microscope picture of fused silica. As shown in FIG. 3, the silicon dioxide particles of fused silica have sharp edges. Furthermore, the average particle size of the fused silica is much bigger than the average particle size of the silica fume shown in FIG. 4.

Figure 4:
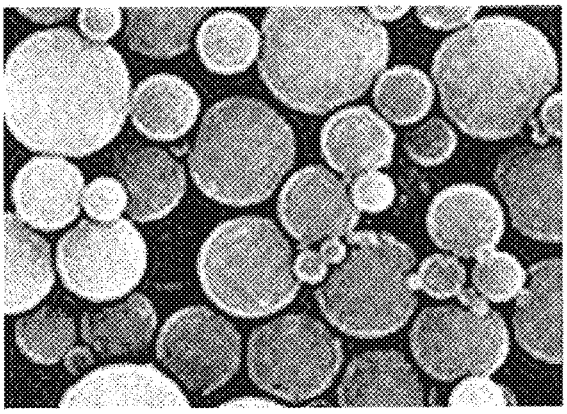
FIG. 4 shows the morphology of silica fume in accordance with an exemplary embodiment of the disclosure.

FIG. 4 shows the morphology of silica fume in accordance with an exemplary embodiment of the disclosure. Namely, FIG. 4 is an electron microscopy picture of silica fume. In contrast to FIG. 3, the silicon dioxide particles have a different shape. There are no longer sharp edges, but spheres. It should be understood that the enlargement of the silicon dioxide particles in FIG. 3 does not correspond to the enlargement of the silicon dioxide particles in FIG. 4. Furthermore, the use of silica fume creates a smoother surface because the particles are less in size compared with the particles of fused silica. Summarizing it can be said that the morphology and the size of the silicon dioxide particles are important for the properties during the production process here the compound will be liquid of the pole part.

While the disclosure has been illustrated and described in detail in the drawings and foregoing description, such illustration and description are to be considered illustrative or exemplary and not restrictive; the disclosure is not limited to the disclosed exemplary embodiments. Other variations to the disclosed exemplary embodiments can be understood and effected by those skilled in the art and practicing the claimed disclosure, from a study of the drawings, the disclosure, and the appended claims. For example, shape and size of the isolating housing 2 of the embedded pole part 1 is not restrictive, but shape and size of the amorphous, non-porous spheres of silicon dioxide. Furthermore, the vacuum circuit breaker 6 can include another type of actuator 7 for generating an operation force which is transmitted via the jackshaft arrangement 8 to the vacuum interrupter 3.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The following further aspects can be concluded under the described exemplary embodiments.

According to an exemplary embodiment of the present disclosure, an average particle size of the amorphous, non-porous spheres of silicon dioxide is smaller than 0.3 micron, more preferably smaller than 0.2 micron, and most preferably smaller than 0.15 micron. Furthermore, an average particles size of the agglomerates of the amorphous, non-porous spheres of the silicon dioxide can be smaller than 2 micron, more preferably smaller than 1.5 micron, and most preferably smaller than 1 micron.

According to yet another exemplary embodiment, the filler material can have a percentage of more than 60 wt.-%, more preferably more than 70 wt.-%, and most preferably more than 80 wt.-%. Through a higher filling material content the flame retardant class can be increased, wherein the epoxy material is reduced in a certain volume. Furthermore, it takes place an increasing density of the compound and later on at the cured part generated by small amorphous, non-porous spheres of silicon dioxide inside the gaps between bigger agglomerates of amorphous, non-porous spheres of silicon dioxide.

Thus, it will be appreciated by those skilled in the art that the present invention can be embodied in other specific forms without departing from the spirit or essential characteristics thereof. The presently disclosed exemplary embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 embedded pole part
2 isolating housing
3 vacuum interrupter
4 upper electric terminal
5 lower electric terminal
6 vacuum circuit breaker
7 actuator
8 jackshaft arrangement
9 coil
10 upper electrical contact
11 lower electrical contact
12 flexible conductor
13 ferromagnetic plunger
14 axis
15 ferromagnetic frame
16 permanent magnet

What is claimed is:

1. An embedded pole part, comprising:

an isolating housing, which includes a vacuum interrupter and electric terminals by an injected embedding material, wherein the injected embedding material is filled with silica based on silicon dioxide as filler material, wherein the silica is silica fume microsilica, which includes amorphous, non-porous spheres of silicon dioxide and agglomerates thereof, and wherein an average particle size of the amorphous, non-porous spheres of silicon dioxide is smaller than 0.3 micron.

2. The embedded pole part of claim 1, wherein an average particle size of the amorphous, non-porous spheres of silicon dioxide is smaller than 0.2 micron.

3. The embedded pole part of claim 2, wherein an average particle size of the amorphous, non-porous spheres of silicon dioxide is smaller than 0.15 micron.

4. The embedded pole part of claim 1, wherein an average particle size of the agglomerates of the amorphous, non-porous spheres of the silicon dioxide is smaller than 2 micron.

5. The embedded pole part of claim 4, wherein an average particle size of the agglomerates of the amorphous, non-porous spheres of the silicon dioxide is smaller than 1.5 micron.

6. The embedded pole part of claim 5, wherein an average particle size of the agglomerates of the amorphous, non-porous spheres of the silicon dioxide is smaller than 1 micron.

7. The embedded pole part of claim 1, wherein, a bulk density of the silica fume is between 100 kg/cbm and 1000 kg/cbm.

8. The embedded pole part of claim 7, wherein, a bulk density of the silica fume is between 200 kg/cbm and 800 kg/cbm.

9. The embedded pole part of claim 8, wherein, a bulk density of the silica fume is between 250 kg/cbm and 700 kg/cbm.

10. The embedded pole part of claim 1, wherein a bulk density of the silica fume is between 2.1 t/cbm and 2.4 t/cbm.

11. The embedded pole part of claim 10, wherein a bulk density of the silica fume is between 2.2 t/cbm and 2.3 t/cbm.

12. The embedded pole part of claim 1, wherein the filler material has a percentage of more than 60 wt.-%.

13. The embedded pole part of claim 12, wherein the filler material has a percentage of more than 70 wt.-%.

14. The embedded pole part of claim 13, wherein the filler material has a percentage of more than 80 wt.-%.

15. The embedded pole part of claim 1, wherein the injected embedding material is duroplastic material.

16. The embedded pole part of claim 15, wherein the duroplastic material is an epoxy material.

17. The embedded pole part of claim 1, wherein the injected embedding material is thermoplastic material.

18. The embedded pole part of claim 1, wherein the injected embedding material is silicone.

19. A medium voltage vacuum circuit breaker, comprising:

an actuator for generating an operation force wherein the operation force is transmitted via a jackshaft arrangement to a vacuum interrupter which is embedded in an isolating housing of an embedded pole part according to claim 1.

* * * * *